US010995756B2

(12) United States Patent
Kotani et al.

(10) Patent No.: US 10,995,756 B2
(45) Date of Patent: May 4, 2021

(54) AIR COMPRESSOR

(71) Applicant: Hitachi, Ltd., Tokyo (JP)

(72) Inventors: Masanao Kotani, Tokyo (JP); Takeshi Tsuchiya, Tokyo (JP); Ryoji Kawai, Tokyo (JP); Kotaro Chiba, Tokyo (JP); Minako Kanada, Tokyo (JP); Sachio Sekiya, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 178 days.

(21) Appl. No.: 16/312,382

(22) PCT Filed: Mar. 24, 2017

(86) PCT No.: PCT/JP2017/011912
§ 371 (c)(1),
(2) Date: Dec. 21, 2018

(87) PCT Pub. No.: WO2018/003211
PCT Pub. Date: Jan. 4, 2018

(65) Prior Publication Data

US 2019/0242382 A1 Aug. 8, 2019

(30) Foreign Application Priority Data

Jun. 28, 2016 (JP) ..... JP2016-127151

(51) Int. Cl.
*F04C 29/02* (2006.01)
*F04C 29/04* (2006.01)
(Continued)

(52) U.S. Cl.
CPC ..... *F04C 29/026* (2013.01); *F04B 39/0207* (2013.01); *F04B 39/0284* (2013.01);
(Continued)

(58) Field of Classification Search
CPC ..... F04C 18/16; F04C 29/0007; F04C 29/02; F04C 29/021; F04C 29/026; F04C 29/042;
(Continued)

(56) References Cited

U.S. PATENT DOCUMENTS 4,289,461 A * 9/1981 van Oorschot ..... F04C 29/0014 418/84
7,059,837 B2 * 6/2006 Nichol ..... F04C 28/08 184/6.16
(Continued)

FOREIGN PATENT DOCUMENTS

CN 1584334 A 2/2005
CN 1862019 A 11/2006
(Continued)

OTHER PUBLICATIONS

International Search Report (PCT/ISA/210) issued in PCT Application No. PCT/JP2017/011912 dated Jun. 13, 2017 with English translation (four (4) pages).
(Continued)

*Primary Examiner* — Alexander B Comley
(74) *Attorney, Agent, or Firm* — Crowell & Moring LLP

(57) ABSTRACT

Provided is an air compressor which helps to attain a proper discharge air temperature and which is superior in energy saving property. There are provided an air line connecting an air compressor, an oil separator, and an after cooler; an oil circulation line connecting the air compressor, the oil separator, and an oil cooler; a bearing oil supply line connecting one end of an intermediate branching portion disposed at an intermediate point of the oil circulation line between the oil cooler and the air compressor to a bearing oil supply portion of the air compressor; an intermediate portion oil supply line connecting the other end of the intermediate branching portion to an intermediate oil supply portion of the air
(Continued)

compressor; a branching line supplying oil to the bearing oil supply portion and the intermediate oil supply portion; a blower sending air to the oil cooler and the after cooler; a bypass line connecting one end of a bypass branching portion disposed at an intermediate point of the oil circulation line between the oil separator and the oil cooler to the downstream side of the oil cooler of the bearing oil supply line; and a control valve controlling the inflow amount of the lubricating oil to the bypass line.

3 Claims, 6 Drawing Sheets

(51) Int. Cl.
*F04B 39/16* (2006.01)
*F04B 39/02* (2006.01)

(52) U.S. Cl.
CPC ..... *F04B 39/16* (2013.01); *F04C 29/021* (2013.01); *F04C 29/042* (2013.01); *F04B 39/02* (2013.01); *F04B 39/0238* (2013.01); *F04C 2270/19* (2013.01)

(58) Field of Classification Search
CPC ..... F04C 2270/19; F04B 39/0238; F04B 39/0284; F04B 39/16; F04B 2205/10; F04B 39/0207–023; F04B 39/02–0207; F01C 21/001; F01C 21/04–045
USPC ..... 418/84, 85, 87; 184/6.16, 6.22
See application file for complete search history.

(56) References Cited

U.S. PATENT DOCUMENTS

| | | | |
|---|---|---|---|
| 2008/0152524 | A1 | 6/2008 | Kishi et al. |
| 2009/0087320 | A1 | 4/2009 | Tanaka et al. |
| 2011/0014077 | A1 | 1/2011 | Martens |
| 2012/0207634 | A1 | 8/2012 | Heger et al. |

FOREIGN PATENT DOCUMENTS

| | | | | | |
|---|---|---|---|---|---|
| CN | 101398004 | A | | 4/2009 | |
| CN | 104136780 | A | | 11/2014 | |
| JP | 57-24952 | Y2 | | 5/1982 | |
| JP | 10-159764 | A | | 6/1998 | |
| JP | 2000-145679 | A | | 5/2000 | |
| JP | 2014-88876 | A | | 5/2014 | |
| JP | 2014-214704 | | * | 11/2014 | |
| JP | 2014-214704 | A | | 11/2014 | |
| JP | 2016-200058 | A | | 12/2016 | |
| WO | WO 2013/175817 | A1 | | 11/2013 | |
| WO | WO-2013175817 | A1 | * | 11/2013 | ..... F04C 29/021 |

OTHER PUBLICATIONS

Japanese-language Written Opinion (PCT/ISA/237) issued in PCT Application No. PCT/JP2017/011912 dated Jun. 13, 2017 (five (5) pages).
Chinese-language Office Action issued in Chinese Application No. 201780036196.1 dated Jun. 2, 2020 with English translation (four (4) pages).

* cited by examiner

AIR COMPRESSOR

TECHNICAL FIELD

The present invention relates to an air compressor.

BACKGROUND ART

A prior-art technique regarding an oil-cooled air compressor is disclosed, for example, in JP-2014-88876-A (Patent Document 1). The abstract of Patent Document 1 discloses "a cooling of a liquid injection type compressor element section in which a liquid is injected into a compression chamber of the compressor element section via an injection valve, the cooling including a step of controlling the amount of the liquid injected into the compression chamber of the compressor element section in accordance with a specific control parameter independently of any other possible adjustment device."

PRIOR ART DOCUMENT

Patent Document

Patent Document 1: JP-2014-88876-A

SUMMARY OF THE INVENTION

Problem to be Solved by the Invention

In general, in the oil cooled compressor, the compressed air is cooled by supplying the compressor with a lubricating oil during compression. At the same time, the lubricating oil is also supplied to a bearing. At low temperature, the viscosity of the lubricating oil increases, so that the power of the compressor is allowed to be increased. From this point of view, it is necessary for the lubricating oil supplied to the bearing to be at a temperature higher than that of the lubricating oil supplied to an intermediate part of the compressor.

According to Patent Document 1, the discharge temperature of the compressor is controlled by controlling the circulation amount of the lubricating oil, and the influence on the power of the difference in temperatures of lubricating oils supplied to the bearing and the intermediate part is not taken into consideration. That is, it has no means supplying lubricating oils of a plurality of different temperatures from a plurality of portions, and it is impossible to attain a suitable lubricating oil temperature for each portion to which the oil is supplied.

In view of this, it is an object of the present invention to provide an air compressor which helps to attain a proper discharge air temperature and which is superior in energy saving property.

Means for Solving the Problem

To achieve the above object, there is provided, in accordance with the present invention, an air compressor unit including: an air compressor; an oil separator separating compressed air discharged from the air compressor and a lubricating oil from each other; an oil cooler cooling the lubricating oil discharged from the oil separator; an after cooler cooling discharged air from the air compressor; an air line effecting connection such that the discharged air successively flows through the air compressor, the oil separator, and the after cooler; an oil circulation line effecting connection such that the lubricating oil successively circulates through the air compressor, the oil separator, and the oil cooler; an intermediate branching portion disposed at an intermediate point of the oil circulation line between the oil cooler and the air compressor; a bearing oil supply line connecting one end of the intermediate branching portion to a bearing oil supply portion of the air compressor; an intermediate oil supply line connecting the other end of the intermediate branching portion to an intermediate oil supply portion of the air compressor; a branching line supplying the lubricating oil to the bearing oil supply portion and the intermediate oil supply portion; and a blower sending cooling air to the oil cooler and the after cooler, wherein the air compressor unit further includes: a bypass branching portion disposed at an intermediate point of the oil circulation line between the oil separator and the oil cooler; a bypass line connecting one end of the bypass branching portion to a downstream side of the oil cooler of the bearing oil supply line; and a control valve controlling an inflow amount of the lubricating oil to the bypass line.

Effect of the Invention

As described above, in accordance with the present invention, it is possible to provide an air compressor which helps to achieve a proper discharge air temperature of the air compressor and which is superior in energy saving property.

MODES FOR CARRYING OUT THE INVENTION

Figure 1:
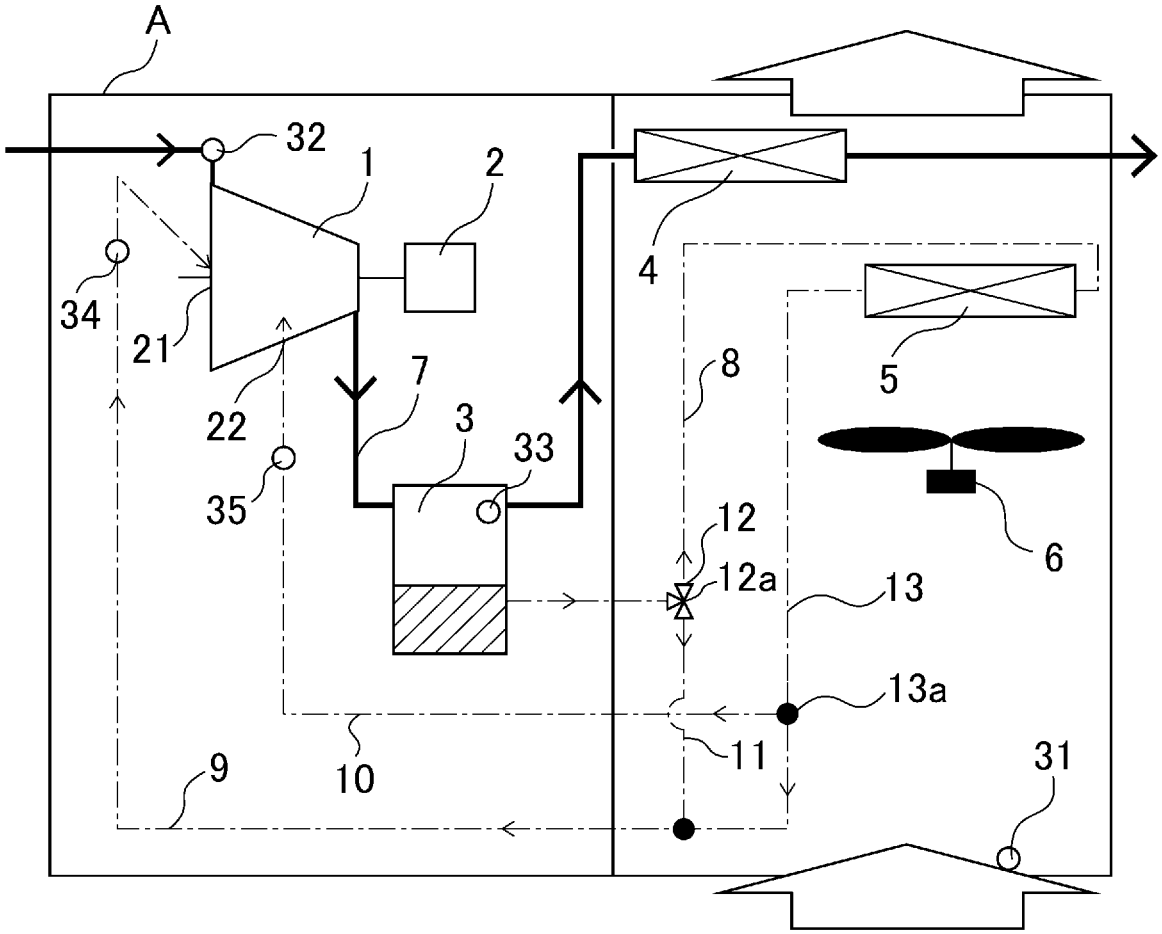
FIG. 1 is a circuit diagram illustrating an air compressor unit according to an embodiment of the present invention.

To reduce the power of an air compressor (hereinafter sometimes referred to simply as the "compressor") by supplying lubricating oil to the intermediate portion and the bearing portion of the compressor, first, it is necessary that the temperature of the lubricating oil supplied to the intermediate portion of the compressor should be lower than the temperature of the compressed air around the intermediate portion. Second, it is necessary that the temperature of the lubricating oil supplied to the bearing portion should be higher than the temperature of the lubricating oil supplied to the intermediate portion at least. Third, in order that the increase in the viscosity of the lubricating oil supplied to the bearing portion may not affect the power of the compressor, the lubricating oil should be controlled to a proper temperature, thereby making it possible to achieve a further reduction in power.

In view of this, there is provided an oil-cooled air compressor unit that compresses sucked air and discharges compressed air and that is equipped with: an oil separator separating compressed air discharged from a compressor main body and a lubricating oil from each other; an oil cooler cooling the lubricating oil discharged from the oil separator with external air; an after cooler for cooling the air discharged from the compressor main body to a predetermined air temperature; an air line effecting connection such that the discharged air successively flows through the air compressor, the oil separator, and the after cooler; an oil circulation line effecting connection such that the lubricating oil successively circulates through the air compressor, the oil separator, and the oil cooler; an intermediate branching portion disposed at an intermediate point of the oil circulation line connecting the oil cooler and the compressor main body; a bearing oil supply line connecting one end of the intermediate branching portion to a bearing oil supply portion of the compressor main body; an intermediate portion oil supply line connecting the other end of the intermediate branching portion to an intermediate oil supply portion of the compressor main body; a branching line supplying the lubricating oil simultaneously to the bearing oil supply portion and the intermediate oil supply portion; and a blower sending cooling air for cooling the oil cooler and the after cooler, the air compressor unit is further equipped with: a bypass branching portion disposed at an intermediate point of the oil circulation line connecting the oil separator and the oil cooler, a bypass line connecting one end of the bypass branching portion to the bearing oil supply line; and a control valve provided at the bypass branching portion and configured to control the flow rate ratio of the lubricating oils flowing into the oil cooler and the bypass line.

Due to this construction, it is possible to make variable the flow rate ratio of the lubricating oil cooled by the oil cooler and the lubricating oil not passing through the oil cooler. As a result, it is possible to control the temperature of the lubricating oil supplied to the bearing of the compressor main body to an appropriate level. Even if the temperature of the lubricating oil supplied to the intermediate portion is relatively low from the viewpoint of the shaft power, it is possible to control it to an appropriate temperature due to the lubricating oil supplied to the bearing.

Further, there is provided detection means detecting the air temperature outside the casing of the oil-cooled air compressor (outside the air compressor unit), the sucked-in air temperature of the air compressor, the air temperature inside the oil separator, and the lubricating oil supply temperatures at the bearing oil supply portion and at the intermediate oil supply portion.

Due to this construction, it is possible to detect the temperatures of the lubricating oil at the bearing oil supply portion and the intermediate oil supply portion. At the same time, due to the difference in the temperatures of the lubricating oils to be supplied to the bearing oil supply portion and the intermediate oil supply portion, it is possible to control the flow rate ratio of the lubricating oils flowing into the bypass line and the oil cooler.

Further, there is provided control means controlling the revolution speed of the blower, the revolution speed of the air compressor, and the opening degree of the control valve on the basis of the temperature information detected by the diction means.

Due to this construction, the revolution speed of the blower is properly controlled, whereby it is possible to properly control the heat radiation amount of the lubricating oil and the air. The revolution speed of the air compressor is properly controlled, whereby it is possible to properly control the heating amount of the lubricating oil and the air. Further, by controlling the opening degree of the bypass line (the opening degree of the control valve), it is possible to properly control the flow rate ratio of the lubricating oils flowing into the oil cooler and the bypass line and to properly control the heat radiation amount of the lubricating oil. As a result, the discharged air temperature of the air compressor and the lubricating oil temperatures at the intermediate oil supply portion and the bearing oil supply portion can be controlled to required proper temperatures, making it possible to provide an air compressor superior in energy saving property.

An auxiliary oil cooler is provided at an intermediate portion of the bypass line. Further, the auxiliary oil cooler is provided on the downstream side of the oil cooler with respect to the direction in which the cooling air due to the blower is sent.

Due to this construction, the temperature of the cooling air flowing into the auxiliary oil cooler can be maintained at a relatively high level after having passed through the oil cooler. As a result, the lubricating oil supplied to the bearing can be maintained at a relatively high temperature, so that it is possible to provide an air compressor superior in energy saving property.

Further, the intermediate oil supply portion is provided in a plurality of stages with respect to the direction in which the pressure in the compressor main body increases, and, in order to supply the lubricating oil to the plurality of stages of the intermediate oil supply portions, a spray branching portion is provided in the intermediate portion oil supply line, with there being provided detection means detecting the lubricating oil temperature at the spray branching portion.

Due to this construction, it is possible to detect the temperature of the lubricating oil at the intermediate portion of the compressor main body. Further, due to the sucked-in air temperature obtained by detection means provided at the suction port of the air compressor (the air compressor unit), it is possible to control the air temperature of the plurality of stages of the intermediate oil supply portions. As a result, it is possible to properly control the temperature of the intermediate portion oil supply line.

The temperature of the lubricating oil is controlled based on the air temperature of the lowermost stage of the plurality of intermediate oil supply portions. As a result, the temperature of the intermediate portion oil supply line can be controlled to a level lower than the compressed air temperature of the lowermost stage, which is relatively low, so that it is possible to efficiently cool the air inside the compressor main body. As a result, it is possible to provide an air compressor superior in energy saving property.

Embodiment 1

An air compressor unit according to an embodiment of the present invention will be described with reference to FIGS. 1 through 6.

FIG. 1 is a circuit diagram illustrating an air compressor unit A according to an embodiment of the present invention. As depicted in FIG. 1, an air compressor unit A includes an air compressor (compressor main body) 1 compressing air sucked in from the atmosphere, a motor 2 driving the air compressor 1, an oil separator 3 separating compressed air containing oil into oil and air, an after cooler 4 cooling the compressed air, an oil cooler 5 cooling a lubricating oil, a blower 6 for sending air to the after cooler 4 and the oil cooler 5 (as indicated by a hollow arrow in FIG. 1), an air draft path 7 (air line) for bringing the compressed air into conduction (the line indicated by the solid line in FIG. 1), an oil circulation line 8 for circulating the lubricating oil (the line indicated by the chain-dotted line in FIG. 1), a branching line 13 having an intermediate branching portion 13*a* dividing the lubricating oil into a bearing oil supply line 9 and an intermediate portion oil supply line 10 on the downstream side of the oil cooler 5, and a bypass branching portion 12*a* having a control valve 12 for distributing the lubricating oil to the oil cooler 5 and a bypass line 11. Drain water generated in the after cooler 4, etc. is drained through a drain trap or the like (not depicted).

As temperature detection means for controlling the air temperature and the lubricating coil, there are provided detection means (external air temperature detection means) 31 detecting the temperature of the ambient air outside the air compressor unit A, detection means (sucked-in air temperature detection means) 32 detecting the compressor sucked-in air temperature, detection means (air temperature detection means) 33 detecting the compressed air discharge temperature (the air temperature inside the oil separator 3), and detection means (lubricating oil temperature detection means) 34 and 35 respectively detecting the lubricating oil temperatures of a bearing oil supply portion 21 and an intermediate oil supply portion 22. Based on the detection temperatures of the detection means 31 through 35, a controller (not depicted) controls the revolution speed ($N_f$) of the blower 6, the revolution speed ($N_{cp}$) of the air compressor 1, and the opening degree ($R_v$) of the control valve 12. The air compressor unit A thus constructed operates as follows.

Air sucked into the air compressor unit A flows into the air compressor 1, and accompanies the lubricating oil supplied from the bearing oil supply portion 21 and the intermediate oil supply portion 22. Then, it is compressed by the air compressor 1 to become air of high temperature and high pressure before being discharged from the air compressor 1. The compressed air discharged from the air compressor 1 is separated into compressed air and the lubricating oil by the oil separator 3 before flowing into the after cooler 4. The compressed air having flowed into the after cooler 4 undergoes heat exchange with the atmospheric air sent to the after cooler 4 by the blower 6, and it is reduced in temperature to the use temperature range and discharged to the exterior of the air compressor unit A to be utilized as compressed air.

The lubricating oil separated from the compressed air by the oil separator 3 flows into the oil cooler 5 and the bypass line 11 at the control valve 12. Like the compressed air, the lubricating oil having flowed into the oil cooler 5 undergoes heat exchange with the atmospheric air sent to the oil cooler 5 by the blower 6, and is reduced in temperature before flowing out of the oil cooler 5. One portion of the lubricating oil having flowed out of the oil cooler 5 flows into the bearing oil supply line 9 to join the lubricating oil having passed through the bypass line 11 before returning to the bearing oil supply portion 21 of the air compressor 1. The other portion of the lubricating oil having flowed out of the oil cooler 5 flows into the intermediate portion oil supply line 10, and returns to the intermediate oil supply portion 22 of the air compressor 1 to cool the air being compressed.

Figure 2:
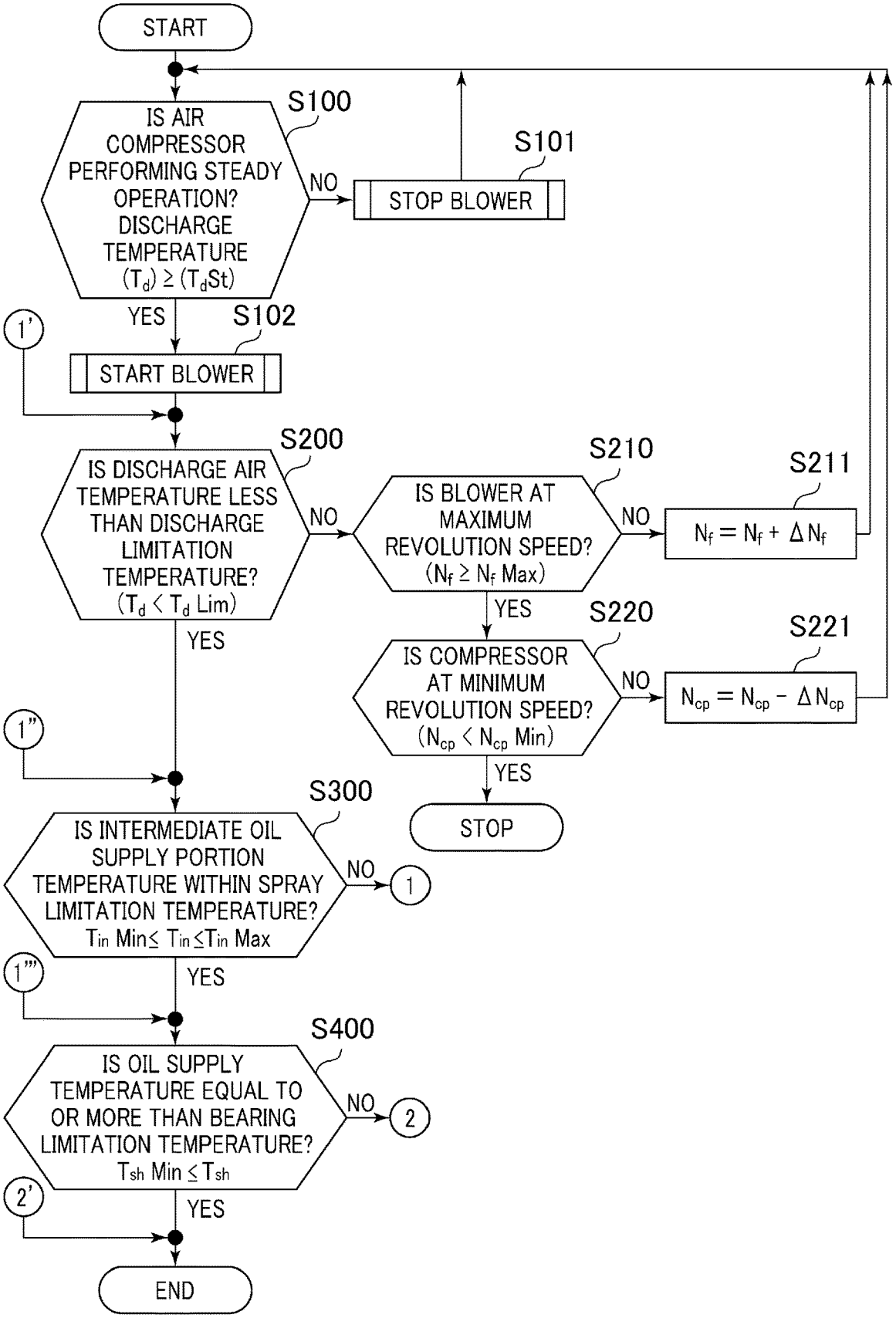
FIG. 2 is a flowchart illustrating the operation of the air compressor unit according to the embodiment of the present invention.
Figure 3:
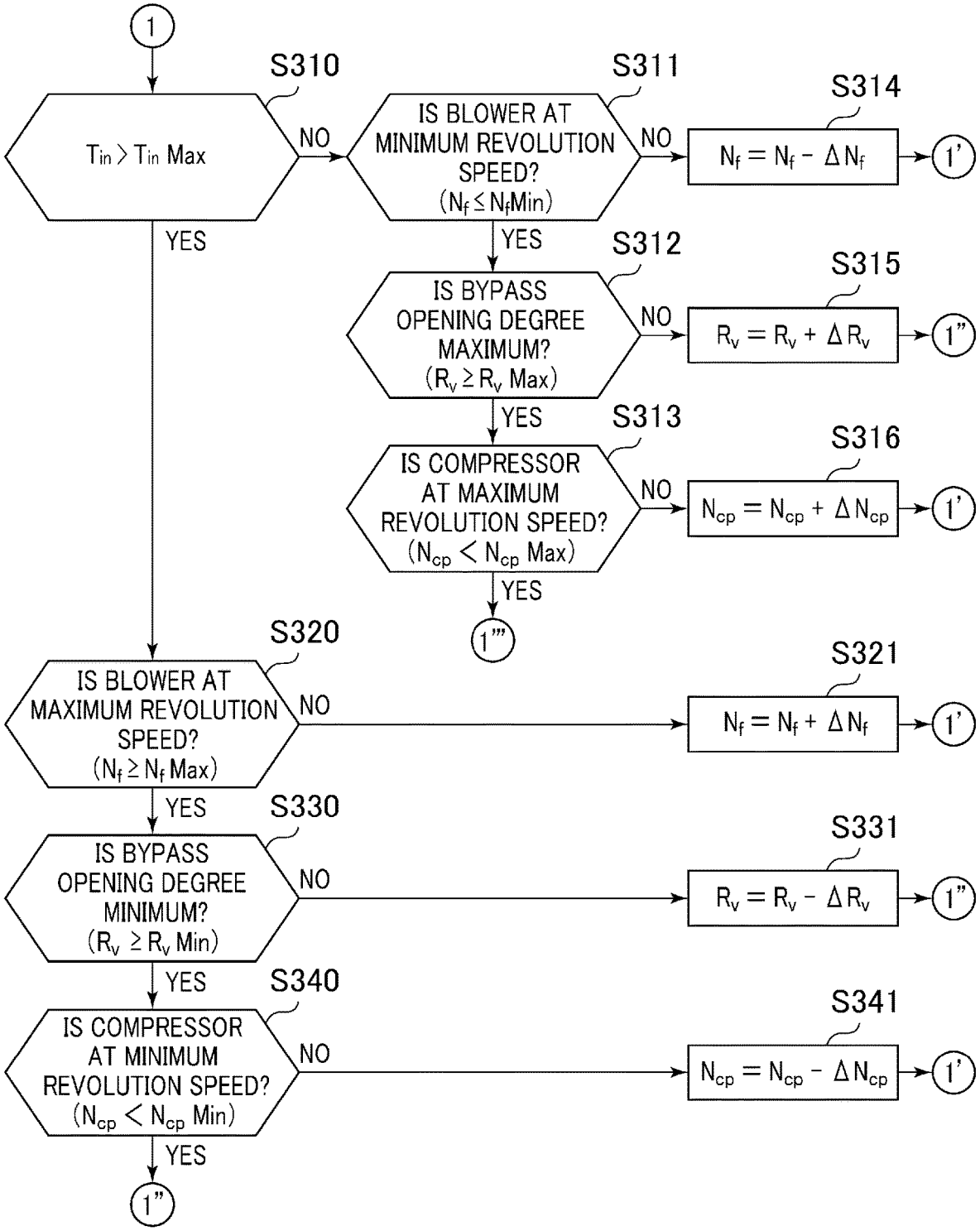
FIG. 3 is a flowchart illustrating the operation of the air compressor unit according to the embodiment of the present invention.
Figure 4:
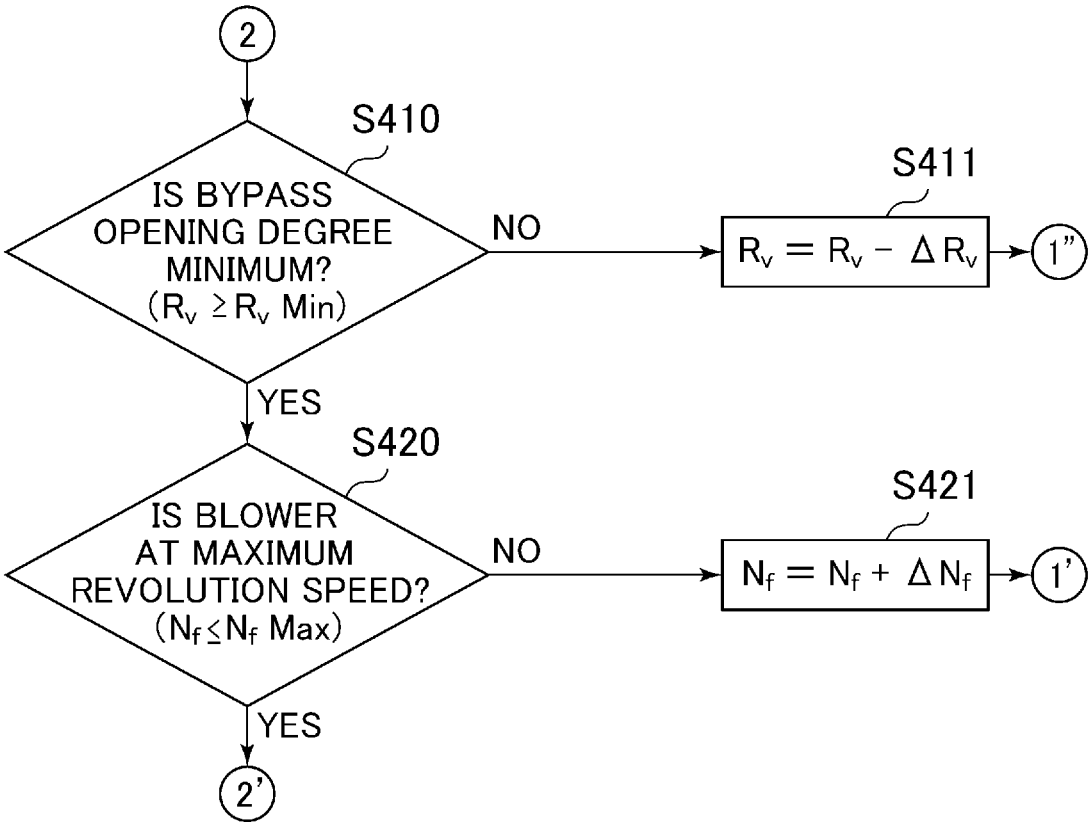
FIG. 4 is a flowchart illustrating the operation of the air compressor unit according to the embodiment of the present invention.

The operational flow of the air compressor unit A, which operates as described below, will be described with reference to FIGS. 2 through 4. FIGS. 2 through 4 are flowcharts illustrating the operation of the air compressor unit according to the embodiment of the present invention. When a start signal is applied to the controller (not depicted) of the air compressor unit A, the air compressor 1 is started at a predetermined revolution speed ($N_{cp}$). At this time, the revolution speed ($N_f$) of the blower 6 is controlled to stop, and the control valve 12 is controlled to be a totally open state (maximum opening degree on the bypass line 11 side). In step S100, it is determined whether or not the air compressor 1 is performing steady operation based on the discharge air temperature ($T_d$) of the detection means 33. The steady operation determination temperature ($T_d$St) is computed from the detection temperature ($T_a$) detected by the detection means 31 detecting the ambient air temperature and the compressor revolution speed ($N_{cp}$), T ($T_a$, $N_{cp}$). In the case where in step S100 the condition: the discharge air temperature ($T_d$)≥the steady operation determination temperature ($T_d$St), is satisfied, the controller determines that the air compressor 1 has attained the steady operation state, and the control operation procedure advances to step S102, where the blower 6 is started at the predetermined revolution speed ($N_f$), with the procedure advancing to step S200. In the case where the above condition is not satisfied, it is determined that the compressor 1 is in the start state, and the control operation procedure advances to step S101, where the blower 6 is maintained in the stop state and is kept on standby until the next control command is applied.

The controller the control operation procedure of which has advanced to step S200 uses the discharge temperature ($T_d$) again to determine whether or not the condition: the discharge air temperature ($T_d$)<the discharge limitation temperature ($T_d$Lim), is satisfied. Here, the discharge limitation temperature ($T_d$Lim) is an operation limitation temperature determined from the reliability of the compressor main body 1. In the case where the condition of step S200 is satisfied, the controller advances the control operation procedure to step S300. In the case where the condition of step S200 is not satisfied, the controller advances the control operation procedure to step S210, where shift is effected to the control for changing the revolution speed ($N_f$) of the blower.

In step S210, it is determined whether or not the condition: the blower revolution speed ($N_f$)≥the blower maximum revolution speed ($N_f$Max). In the case where the condition of step S210 is not satisfied, the condition: the blower revolution speed ($N_f$)=$N_f$+$\Delta N_f$, is attained in step S211 to increase the revolution speed of the blower 6. Then, the blower is kept on standby until the next control command is applied. It is to be noted that $\Delta N_f$ is the differential amount of the revolution speed of the blower. The differential amount is determined by the control system such as fixed value control, proportional control, or PID control.

In the case where the condition of step S210 is satisfied, the blower revolution speed ($N_f$) has reached the control upper limit value ($N_f$Max). Thus, the control operation for the discharge temperature ($T_d$) is shifted from the control by the cooling air to the control in which the heating amount is controlled by the revolution speed ($N_{cp}$) of the air compressor, and the procedure advances to step S220. In step S220, the controller determines whether or not the condition: the compressor revolution speed ($N_{cp}$)<the compressor minimum revolution speed ($N_{cp}$Min), is satisfied. In the case where the condition of step S220 is not satisfied, the condition: the compressor revolution speed ($N_{cp}$)=$N_{cp}$−$\Delta N_{cp}$, is attained in step S221 to reduce the compressor revolution speed, and the compressor is kept on standby until the next control command is applied. It is to be noted that $\Delta N_{cp}$ is the differential amount of the compressor revolution speed, and the differential amount is determined by the control system such as fixed value control, proportional control, or PID control.

In the case where the condition of step S220 is not satisfied, it is impossible to adjust the control parameters so as to satisfy the condition: the steady operation determination temperature ($T_d$St)≤the discharge air temperature ($T_d$) <the discharge limitation temperature ($T_d$Lim), so that the controller determines that there is a system error and stops the compressor unit A.

In the case where the condition of step S200 is satisfied, the controller advances the control operation procedure to step S300, and determines whether or not the temperature of the lubricating oil supplied to the intermediate oil supply portion 22, [the intermediate oil supply portion temperature ($T_{in}$)], satisfies a predetermined condition. At this time, the intermediate oil supply portion temperature ($T_{in}$) is gained by the detection means 35. In step S300, the controller determines whether or not the condition: the intermediate oil supply portion minimum temperature ($T_{in}$Min)≤$T_{in}$≤the intermediate oil supply portion maximum temperature ($T_{in}$Max), is satisfied. In the case where the condition of step S300 is satisfied, the controller advances the control operation procedure to step S400. In the case where the condition is not satisfied, the control operation procedure advances to step S310, where the intermediate oil supply portion temperature ($T_{in}$) is controlled. The intermediate oil supply portion maximum temperature ($T_{in}$Max) is obtained through computation by the equation: $T_{in}Max=T(T_s, X_{in})$, based on the sucked-in air temperature ($T_s$) of the compressor main body 1 gained by the detection means 32 and the intermediate oil supply portion position ($X_{in}$). Similarly, the intermediate oil supply portion minimum temperature ($T_{in}$Max) is a limitation temperature that can be obtained through computation from the dew point temperature ($T_{dew}$) of the compressed air determined by the humidity (RHs) of the sucked-in air.

In the case where the condition of step S300 is satisfied, the controller advances the control operation procedure to step S400, and determines whether or not the oil supply temperature ($T_{sh}$) of the lubricating oil at the bearing oil supply portion 21 satisfies a predetermined condition. At this time, the oil supply temperature ($T_{sh}$) of the lubricating oil at the bearing oil supply portion 21 is gained by the detection means 34. In step S400, the controller determines whether or not the condition: the bearing oil supply temperature ($T_{sh}$) ≥the bearing limitation minimum temperature ($T_{sh}$Min), is satisfied. In the case where the condition of step S400 is satisfied, the controller completes the control operation, and is kept on standby until the next control signal is applied. In the case where the condition of step S400 is not satisfied, the controller advances the control operation procedure to step S410.

FIG. 3 is a flowchart illustrating the control operation in the case where the condition of step S300 is not satisfied. In the control step S310, the controller determines whether or not the condition: the intermediate oil supply portion temperature ($T_{in}$)>the intermediate oil supply portion maximum temperature ($T_{in}$Max), is satisfied. In the case where the condition of step S310 is satisfied, the controller determines that the intermediate oil supply portion temperature ($T_{in}$) is high, and advances the control operation procedure to step S320, where the temperature of the lubricating oil is lowered. In the case where the condition of step S310 is not satisfied, the controller determines that the intermediate oil supply portion temperature ($T_{in}$) is low, and the procedure advances to step S311, where there is performed a control operation to raise the temperature of the lubricating oil. When the control operation procedure has advanced to step S311, the controller determines whether or not the condition: the blower revolution speed ($N_f$)≤the blower minimum revolution speed ($N_f$Min), is satisfied. In the case where the condition of step S311 is not satisfied, the controller attains in step S314 the condition: the blower revolution speed ($N_f$)=$N_f-\Delta N_f$ to reduce the revolution speed of the blower 6, thereby reducing the heat radiation amount of the lubricating oil. After this, the controller is kept on standby until the next control command is applied.

In the case where the condition of step S311 is satisfied, the revolution speed of the blower 6 has reached the control lower limit value ($N_f$Min). Thus, the controller advances to a control operation to adjust the opening degree of the control valve 12 adjusting the flow rate ratio of the lubricating oils flowing into the oil cooler 5 and the bypass line 11 (the communication opening degree with respect to the bypass line 11) ($R_v$), which is a control parameter other than the revolution speed of the blower 6. In step S312, the controller determines whether or not the condition: the bypass opening degree ($R_v$)≥the bypass maximum opening degree ($R_v$Max), is satisfied. In the case where the condition of step S312 is not satisfied, the controller attains in step S315 the condition: the bypass opening degree ($R_v$)=$R_v+\Delta R_v$ to increase the bypass opening degree (the communication opening degree with respect to the bypass line 11). As a result, the flow rate ratio ($G_{oc}/G_B$) of the lubricating oils flowing into the oil cooler 5 and the bypass line 11 decreases, and the heat radiation amount of the lubricating oil at the oil cooler 5 decreases. After this, the controller is kept on standby until the next control command is applied.

In the case where the condition of step S312 is satisfied, the revolution speed ($N_f$) of the blower and the bypass opening degree ($R_v$) are in excess of the respective control limitation values. Thus, the controller advances to a control operation to control the heating amount not by the heat radiation amount radiated into the atmosphere to adjust the temperature of the lubricating oil but by the revolution speed ($N_{cp}$) of the air compressor 1, and the procedure advances to the operation step S313. In step S313, the controller determines whether or not the condition: the compressor revolution speed ($N_{cp}$)<the compressor minimum revolution speed ($N_{cp}$Max). In the case where the condition of step S313 is not satisfied, there is attained in step S316 the condition: the compressor revolution speed ($N_{cp}$)=$N_{cp}+\Delta N_{cp}$ to increase the compressor revolution speed, and the controller is kept on standby until the next control command is applied.

In the case where the condition of step S313 is not satisfied, the controller advances to step S340, where there is performed a control operation to control the temperature of the lubricating oil supplied to the bearing.

FIG. 4 is a flowchart illustrating the control operation in the case where the condition of the control step S400 is not satisfied. In step S410, the controller determines whether or not the condition: the bypass opening degree ($R_v$)≥the bypass minimum opening degree ($R_v$Min), is satisfied. In the case where the condition of step S410 is not satisfied, the controller attains in step S411 the condition: the bypass opening degree ($R_v$)=$R_v-\Delta R_v$ to decrease the bypass opening degree. As a result, the flow rate ratio ($G_{oc}/G_B$) of the lubricating oils flowing into the oil cooler 5 and the bypass line 11 increases, and the heat radiation amount of the lubricating oil at the oil cooler 5 increases. After this, the controller is kept on standby until the next control command is applied.

In the case where the condition of step S410 is satisfied, the bypass opening degree ($R_v$) has reached the control lower limit value, so that the procedure of the controller advances to step S420. When the control operation procedure has advanced to step S420, the controller determines whether or not the condition: the blower revolution speed ($N_f$)≤the blower minimum revolution speed ($N_f$Max), is satisfied. In the case where the condition of step S420 is not satisfied, the controller attains in step S420 the condition: the blower revolution speed ($N_f$)=$N_f$+$\Delta N_f$ to increase the revolution speed of the blower 6, thereby controlling the heat radiation amount of the lubricating oil. After this, the controller is kept on standby until the next control command is applied.

In the case where the condition of step S420 is satisfied, the controller completes the control operation, and is kept on standby until the next control command is applied.

Figure 5:
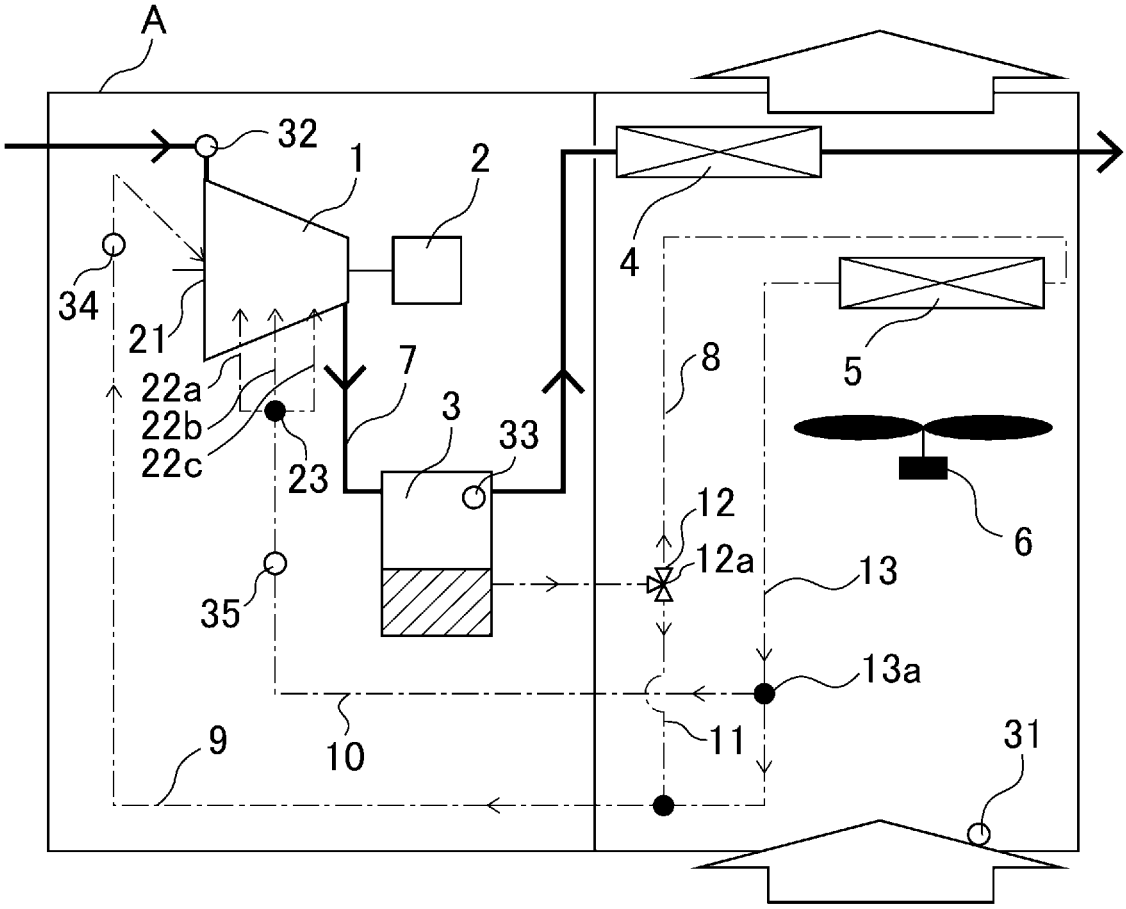
FIG. 5 is a circuit diagram illustrating an air compressor unit according to another embodiment of the present invention.

Next, another embodiment different from the above embodiment will be described. FIG. 5 is a circuit diagram illustrating an air compressor unit according to another embodiment of the present invention. In the example depicted in FIG. 5, intermediate oil supply portions 22*a*, 22*b*, and 22*c* provided in the air compressor 1 are provided at a plurality of pressure points. The operation of the air compressor and the main structure of the embodiment depicted in FIG. 5 are the same as those of the embodiment depicted in FIG. 1, so that, here, the same components are indicated by the same reference numerals, and a description of the operation and control thereof will be left out.

As depicted in FIG. 5, also in the case where a plurality of stages of intermediate oil supply portions 22*a*, 22*b*, and 22*c* are provided in the direction in which the pressure inside the air compressor 1 increases, there is provided in the upstream portion 40 of the spray branching portion 23 detection means 35 detecting the lubricating oil temperature at the spray branching portion 23 and the intermediate oil supply portion 22*a*, 22*b*, and 22*c*, whereby the control illustrated in FIGS. 2 through 4 are applicable. As a result, it is possible to properly control the discharge air temperature of the air compressor and the supply temperature of the lubricating oil.

Figure 6:
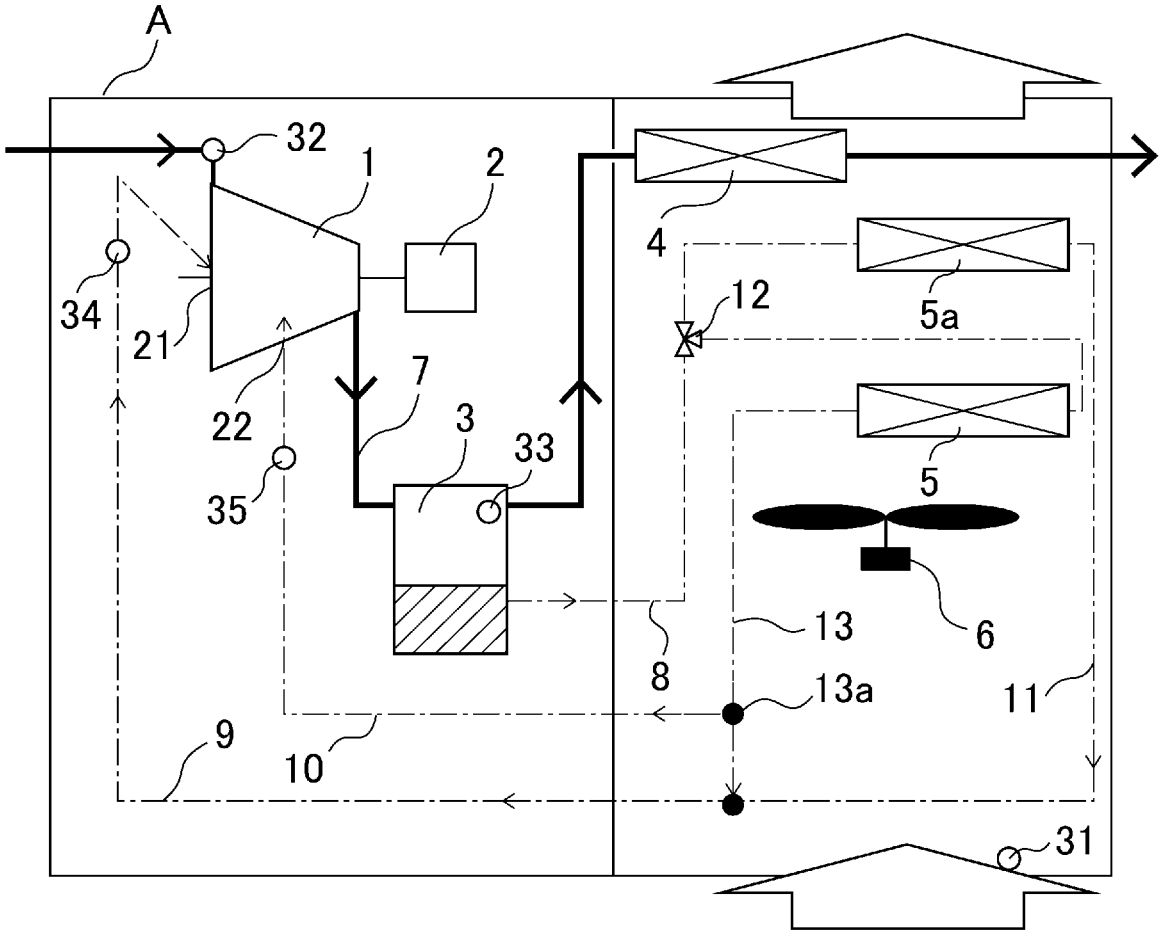
FIG. 6 is a circuit diagram illustrating an air compressor unit according to still another embodiment of the present invention.

Next, FIG. 6 is a circuit diagram illustrating an air compressor unit according to still another embodiment of the present invention. In the example depicted in FIG. 6, an auxiliary oil cooler 5*a* for the bearing oil supply is provided in the bypass line 11. Also in the embodiment of FIG. 6, the operation of the air compressor and the main structure are the same as those of the embodiment depicted in FIG. 1, so that, here, the same components are indicated by the same reference numerals, and a description of the operation and control thereof will be left out.

The auxiliary oil cooler 5*a* is provided on the downstream side of the oil cooler 5 with respect to the blower 6. Thus, the temperature of the air flowing through the auxiliary oil cooler 5*a* is higher than the ambient air temperature. Further, the bearing oil supply temperature can be directly controlled by the auxiliary oil cooler, so that it is possible to actively control the oil supply temperature of the bearing.

The present invention is not restricted to the embodiments described above but includes various modifications. For example, detection means such as a temperature sensor and a humidity sensor may be applied as the detection means of the embodiments, making it possible to detect the condition of the lubricating oil and the air. That is, the structure of the embodiment may be partially replaced or converted within the range in which the object of the present invention can be achieved. That is, the above-described embodiments, which serve to facilitate the understanding of the preset invention, are not always restricted to a structure equipped with the components described above.

DESCRIPTION OF REFERENCE CHARACTERS

A Air compressor unit
1 Air compressor (compressor main body)
3 Oil separator
4 After cooler
5 Oil cooler
5*a* Auxiliary oil cooler
6 Blower
7 Air line
8 Oil circulation line
9 Bearing oil supply line
10 Intermediate portion oil supply line
11 Bypass line
12 Control valve
12*a* Bypass branching portion
13 Branching line
13*a* Intermediate branching portion
21 Bearing oil supply portion
22 Intermediate oil supply portion
22*a*, 22*b*, 22*c* Intermediate oil supply portion
23 Spray branching portion
31 Detection means (external air temperature detection means)
32 Detection means (sucked-in air temperature detection means)
33 Detection means (air temperature detection means)
34 Detection means (lubricating oil temperature detection means)
35 Detection means (lubricating oil temperature detection means)

The invention claimed is:

1. An air compressor unit comprising:

an air compressor;

an oil separator separating compressed air discharged from the air compressor and a lubricating oil from each other;

an oil cooler cooling the lubricating oil discharged from the oil separator;

an after cooler cooling discharged air from the air compressor;

an air line effecting connection such that the discharged air successively flows through the air compressor, the oil separator, and the after cooler;

an oil circulation line effecting connection such that the lubricating oil successively circulates through the air compressor, the oil separator, and the oil cooler;

an intermediate branching portion disposed at an intermediate point of the oil circulation line between the oil cooler and the air compressor;

a bearing oil supply line connecting one end of the intermediate branching portion to a bearing oil supply portion of the air compressor;

an intermediate oil supply line connecting another end of the intermediate branching portion to an intermediate oil supply portion of the air compressor;

a branching line supplying the lubricating oil to the bearing oil supply portion and the intermediate oil supply portion;

a blower sending cooling air to the oil cooler and the after cooler, wherein the air compressor unit further includes a bypass branching portion disposed at an intermediate point of the oil circulation line between the oil separator and the oil cooler, a bypass line connecting one end of the bypass branching portion to the bearing oil supply line at a location downstream of the oil cooler, and a control valve controlling an inflow amount of the lubricating oil to the bypass line; and a first detector that detects an air temperature outside the air compressor unit, a second detector that detects a sucked-in air temperature of the air compressor, a third detector that detects an air temperature inside the oil separator, and a fourth detector that detects oil supply temperatures of the lubricating oil at the bearing oil supply portion and the intermediate oil supply portion, wherein, based on the temperatures detected by the detectors, at least one of a revolution speed of the blower, a revolution speed of the air compressor, and an opening degree of the control valve is controlled.

2. An air compressor unit comprising:

an air compressor;

an oil separator separating compressed air discharged from the air compressor and a lubricating oil from each other;

an oil cooler cooling the lubricating oil discharged from the oil separator;

an after cooler cooling discharged air from the air compressor;

an air line effecting connection such that the discharged air successively flows through the air compressor, the oil separator, and the after cooler;

an oil circulation line effecting connection such that the lubricating oil successively circulates through the air compressor, the oil separator, and the oil cooler;

an intermediate branching portion disposed at an intermediate point of the oil circulation line between the oil cooler and the air compressor;

a bearing oil supply line connecting one end of the intermediate branching portion to a bearing oil supply portion of the air compressor;

an intermediate oil supply line connecting another end of the intermediate branching portion to an intermediate oil supply portion of the air compressor;

a branching line supplying the lubricating oil to the bearing oil supply portion and the intermediate oil supply portion; and a blower sending cooling air to the oil cooler and the after cooler, wherein the air compressor unit further includes a bypass branching portion disposed at an intermediate point of the oil circulation line between the oil separator and the oil cooler, a bypass line connecting one end of the bypass branching portion to the bearing oil supply line at a location downstream of the oil cooler, and a control valve controlling an inflow amount of the lubricating oil to the bypass line, wherein an auxiliary oil cooler is provided on an upstream side of the bypass line, and the auxiliary oil cooler is situated on a downstream side of the oil cooler with respect to an air sending direction of the blower.

3. An air compressor unit comprising:

an air compressor;

an oil separator separating compressed air discharged from the air compressor and a lubricating oil from each other;

an oil cooler cooling the lubricating oil discharged from the oil separator;

an after cooler cooling discharged air from the air compressor;

an air line effecting connection such that the discharged air successively flows through the air compressor, the oil separator, and the after cooler;

an oil circulation line effecting connection such that the lubricating oil successively circulates through the air compressor, the oil separator, and the oil cooler;

an intermediate branching portion disposed at an intermediate point of the oil circulation line between the oil cooler and the air compressor;

a bearing oil supply line connecting one end of the intermediate branching portion to a bearing oil supply portion of the air compressor;

an intermediate oil supply line connecting another end of the intermediate branching portion to an intermediate oil supply portion of the air compressor;

a branching line supplying the lubricating oil to the bearing oil supply portion and the intermediate oil supply portion;

a blower sending cooling air to the oil cooler and the after cooler, wherein the air compressor unit further includes a bypass branching portion disposed at an intermediate point of the oil circulation line between the oil separator and the oil cooler, a bypass line connecting one end of the bypass branching portion to the bearing oil supply line at a location downstream of the oil cooler, and a control valve controlling an inflow amount of the lubricating oil to the bypass line;

wherein the intermediate oil supply portion comprises a plurality of intermediate oil supply portions provided along the air compressor in a direction in which a pressure inside the air compressor increases;

a spray branching portion branching the intermediate portion oil supply line with respect to the plurality of intermediate oil supply portions; and lubricating oil temperature detection means detecting a temperature of the lubricating oil at the spray branching portion, wherein a temperature of the lubricating oil is controlled based on a detection temperature of the lubricating oil temperature detection means and a temperature of a compressed air on a side of the plurality of intermediate oil supply portions at a lower pressure.

* * * * *